US006637518B1

(12) United States Patent
Hillier et al.

(10) Patent No.: US 6,637,518 B1
(45) **Date of Patent: *Oct. 28, 2003**

(54) FIRE EXTINGUISHING APPARATUS

(75) Inventors: Kenneth Hillier, Fremantle (AU); Mitchell Edwin Byfield, Samson (AU)

(73) Assignee: Invention Technologies Pty. Ltd., Subiaco (AU)

( * ) Notice: Subject to any disclaimer, the term of this patent is extended or adjusted under 35 U.S.C. 154(b) by 0 days.

This patent is subject to a terminal disclaimer.

(21) Appl. No.: 08/403,745

(22) PCT Filed: Jul. 12, 1994

(86) PCT No.: PCT/AU94/00389

§ 371 (c)(1),
(2), (4) Date: Feb. 17, 1998

(87) PCT Pub. No.: WO95/02434

PCT Pub. Date: Jan. 26, 1995

(30) Foreign Application Priority Data

Dec. 7, 1993 (AU) ..... PL9935

(51) Int. Cl.[7] ..... A62C 2/00; A62C 3/00

(52) U.S. Cl. ..... 169/46; 169/54; 169/56; 169/60; 169/5; 169/16; 169/19

(58) Field of Search ..... 169/46, 56, 60, 169/61, 7, 19, 5, 16, 54

(56) References Cited

U.S. PATENT DOCUMENTS

| | | | | |
|---|---|---|---|---|
| 2,283,775 A | | 5/1942 | Thompson et al. | |
| 3,783,946 A | * | 1/1974 | Petrinec et al. | 169/61 |
| 4,276,064 A | | 6/1981 | Gerdes | |
| 4,345,654 A | | 8/1982 | Carr | |
| 4,359,097 A | * | 11/1982 | Claussen | 169/16 |
| 4,393,941 A | | 7/1983 | Stevens | |
| 4,697,740 A | | 10/1987 | Ivy | |
| 4,805,862 A | | 2/1989 | Wissman | |
| 4,836,291 A | | 6/1989 | Owens et al. | |
| 4,897,207 A | * | 1/1990 | Greene | 169/46 |
| 5,052,493 A | | 10/1991 | Court | |
| 5,062,487 A | | 11/1991 | Siria et al. | |
| 5,161,621 A | * | 11/1992 | Shlomo | 169/46 |
| 5,211,336 A | | 5/1993 | Kaidonis | |

FOREIGN PATENT DOCUMENTS

| | | | | |
|---|---|---|---|---|
| EP | 0 314 354 | | 5/1989 | |
| FR | 2 674 441 | | 10/1992 | |
| GB | 1 380 903 | | 1/1975 | |
| PL | 14399 | | 8/1961 | |
| RO | 111026 B1 | | 6/1996 | |
| SU | 1223926 | | 4/1986 | |
| SU | 1678392 | | 9/1991 | |
| SU | 1806790 | | 4/1993 | |
| WO | WO 9107208 A2 | * | 5/1991 | A62C/3/08 |
| WO | WO 92/15370 | | 9/1992 | |
| WO | WO 92/20453 | | 11/1992 | |
| WO | WO 93/09848 | | 5/1993 | |
| WO | WO 93/10860 | | 6/1993 | |
| WO | WO 9310861 A1 | * | 6/1993 | A62C/35/58 |

OTHER PUBLICATIONS

Wesselow et al., "Automatischer Brand–und Explosionschutz" (1979) "Flussigkeitszerstaubung mittels Dusen" (1965).

(List continued on next page.)

*Primary Examiner*—Robin O. Evans
(74) *Attorney, Agent, or Firm*—Larson & Taylor PLC

(57) ABSTRACT

A fire extinguishing apparatus (10) producing a mist of water vapour with a median droplet diameter of between 50 and 500 micron for extinguishing fires in a confined risk area. The mist being generated through nozzles (18) operating at <2000 kPa (i.e. low pressure). The fire extinguishing apparatus using less than 1.0 litres of water per cubic meter of the risk area in which the fire is contained (i.e. a small volume of water).

54 Claims, 4 Drawing Sheets

OTHER PUBLICATIONS

P Nash and RA Young: "Automatic Sprinkler Systems for Fire Protection",—Chapter 14 Sprinkler and Water Spray Systems for Special Risks (first edition—1982) cover page and pp. 129–135.

Grimwood, Paul T. (edited by Hoffman, Simon): "Fog Attack Fire Fighting Strategy and Tactics—An International View" (First published in Great Bitain 1992) title page, contents page and chapter 3: "Fog Attack", pp. 65–97.

Ginge–Kerr: "Fine Water Spray System" (dated Nov. 1992, i.e. presumably Nov. 1992, as per endorsement in lower right corner on the last page, p. 4).

Hi–fog Machinery Systems—Fire Protection for the 21st Century. 6 pages (dated Aug. 1992, i.e. 8/92).

* cited by examiner

FIRE EXTINGUISHING APPARATUS

FIELD OF THE INVENTION

The present invention relates to a fire extinguishing apparatus and method relying upon a non-flammable liquid, such as water for extinguishing fire including Class A and B fires with a mist formed from a relatively small amount of liquid at a relatively low pressure. The fire extinguishing apparatus intended for use in closed areas, such as, for example, in engine rooms, pump rooms, machinery spaces, computer rooms, storage rooms and the like. More particularly, the present invention relates to a fire extinguishing apparatus intended for use as a replacement for an existing fire extinguishing apparatus based upon the use of the now banned HALON.

Hereinafter, the present invention will be described with particular reference to use with liquid being water although it could be used with other non-flammable liquids which absorb heat as they vaporise.

BACKGROUND OF THE INVENTION

In fighting fires it is known that there are three major contributing factors to the continuation of the fire. These factors are heat, oxygen and fuel and the interrelationship of these factors is shown pictorially in FIG. 6. Conventionally when extinguishing fires, fire fighters act to remove at least one of the three elements necessary for combustion. Typically, fire fighters use either water, $CO_2$, halon, dry chemical or foam. Water acts by removing the heat from the fuel, whilst carbon dioxide works by displacing the oxygen.

Another aspect of combustion is a chain flame reaction indicated by a circle which contains the triangle, as shown in FIG. 6. The chain flame reaction relies upon free radicals which are created in the combustion process and are essential for of its continuation. Halon operates by attaching itself to the free radicals and thus preventing further combustion by interrupting the flame chain reaction.

The main disadvantage of water is that considerable amounts of water are required in extinguishing a fire which leads to considerable damage by the water. Also, in some instances suitable quantities of water to extinguish the fire are not available. Carbon dioxide and halon both have the disadvantage that all people must be evacuated from the area in which they are to be used must be evacuated since it will become impossible for the people to breathe. For this reason, fire fighters using these extinguishing agents must use breathing apparatus. Also, for $CO_2$ and Halon to extinguish the fire any ventilation of the area must be shut down. Halon has further disadvantage that it is highly toxic and very damaging to the environment. For those reasons, the use of halon in extinguishing fires has been banned in most circumstances.

The present invention overcomes the above disadvantages by using a non-flammable liquid, such as water, to reduce the heat of the vapour around the fuel, reduce the heat of the fuel, displace the oxygen, and interrupt the flame chain reaction. That is, the liquid attacks all parts of the combustion process except for removing the fuel. The invention is based upon the generation of a relatively fine mist of liquid (referred as a mist), such as water, which displaces the oxygen, and upon heating evaporates and expands to further displace the oxygen. Upon expansion the water mist absorbs heat from the vapour around the fuel and from the fuel. Also, the mist interrupts the flame chain reaction by attaching to the free radicals. The mist also has a smothering effect and a cooling effect upon the fire. For these reasons, the mist has the surprising result that a relatively small amount of water can safely be used to extinguish both A and B class fires as well as electrical fires.

The mist generated by the fire extinguishing apparatus of the present invention is not a water on flame scenario. Its operation is more akin to gaseous fire extinguishing mediums such as $CO_2$ or halon.

These surprising results occur due to the very rapid evaporation rate possible with a fine mist of liquid (typically 50–500 microns), the heat absorption characteristics of water as it vaporises, the ability of the fine mist to reduce the convection of heat from the fire to surrounding objects and the ability of the mist to displace oxygen. This is due to the expansion ratio of water from liquid to vapour.

With the fire extinguishing apparatus of the present invention a typical fire confined to a room or the like can be entirely extinguished within about 30 seconds with a number of nozzles each spraying about 0.4 litres of water as mist at about 20 bar, with one nozzle per 2.65 $m^3$. This is a very small rate of application of water to douse a fire when compared to the prior art.

SUMMARY OF THE INVENTION

Therefore, it is an object of the present invention to provide a fire extinguishing apparatus which uses a mist generated from non-flammable liquid applied in relatively small volumes to interrupt the combustion process of a fire in a closed space.

In accordance with one aspect of the present invention there is provided a fire extinguishing apparatus for extinguishing a fire located in a risk area, the fire extinguishing apparatus comprising:

- a storage reservoir containing a non-flammable liquid;
- a spray means for spraying the liquid into the risk area, the spray means forming a mist having a droplet size which enhances the application of the mist to the fire and hence increase the ability for the liquid to extinguish the fire;
- a propelling means for propelling the liquid out of the storage reservoir and through the spray means under pressure for forming the mist;
- a sensor means for detecting the presence of a fire in the risk area;
- a control means in operative association with the sensor means for controlling the propelling means for propelling the liquid out of the storage reservoir.

In accordance with another aspect of the present invention there is provided a method for extinguishing a fire, the method comprising the steps of:

- directing a spray means into the risk area;
- propelling non-flammable liquid through the spray means under pressure for forming a mist having a droplet size which creates an atmosphere that will not support combustion.

Typically, the non-flammable liquid is water.

Preferably, the spray means includes a plurality of nozzles interconnected by pipes.

Preferably, the mist has a droplet size with a median volume diameter or less than about 500 microns.

Typically, the propelling means is a gas contained in the storage reservoir under elevated pressure. Typically, the gas is dry nitrogen. Typically, the gas is pressurised to about 20 bar in the storage reservoir prior to operation of the fire extinguishing apparatus.

BRIEF INTRODUCTION OF HE DRAWINGS

An exemplary embodiment of the present invention will now be described with particular reference to the accompanying drawings, in which.

DETAILED DESCRIPTION OF THE PREFERRED EMBODIMENT

Figure 1:
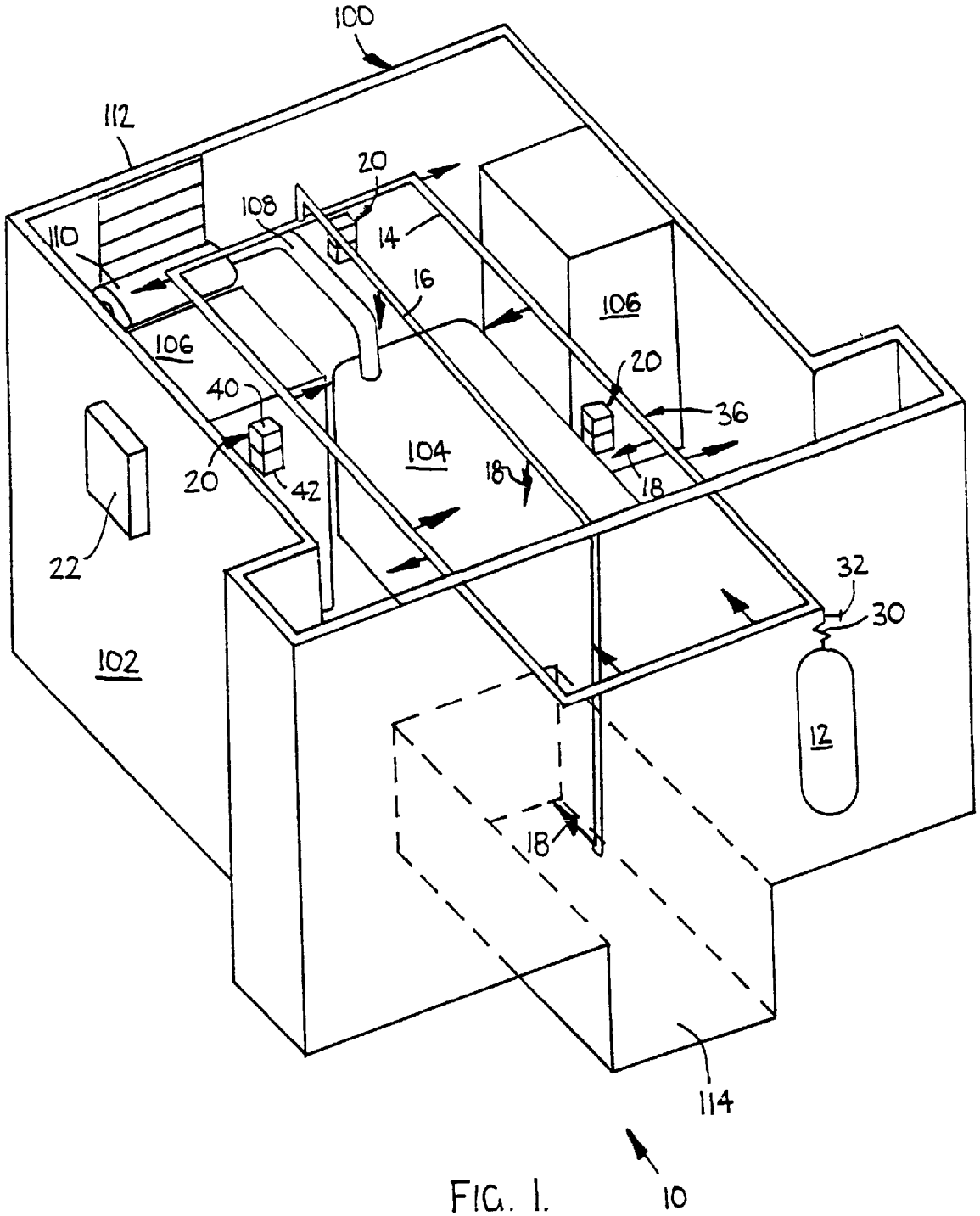
FIG. 1 is a perspective view, seen from above, of an engine room of a ship shown fitted with a fire extinguishing apparatus in accordance with the present invention.

In FIG. 1 there is shown a fire extinguishing apparatus 10 comprising a pressurised container 12, pipes 14 and 16, a plurality of nozzles 18, a plurality of fire detectors 20 and a control panel 22.

Also shown in FIG. 1 is an engine room 100 having a surrounding wall 102 within which is located an engine 104, fuel tanks 106, an exhaust pipe 108, an exhaust muffler 110, a heat exchanger 112, and a propeller shaft well 114. The engine room 100 is a typical layout of the engine room of a ship.

The container 12 is typically made from galvanised metal materials and capable of withstanding pressures up to for example 3000 kPa. Typically, the container 12 has a charge of distilled water maintained under pressure by a charge of dry nitrogen. Typically, the container 12 has a capacity between about 5 and 30 litres. However, the container 12 could have virtually any capacity, although by the nature of the operation of the present invention the container 12 may be much smaller than prior art containers.

Typically, the pressurised container 12 is located proximate the surrounding wall 102. The container 12 has a control valve 30 attached to its outlet for controlling the expulsion of the water under pressure from the container 12. The control valve 30 may be actuated electrically or mechanically and the actuation may be automatic or manual.

The pipes 14 and 16 form a plumbing network 36 attached to the flow rate control valve 32 and each carry a plurality of the nozzles 18. The pipes 14 and 16 and hence the nozzles 18 are strategically located about the engine room 100, as described hereinafter. Also, the nozzles 18 are oriented in strategic directions from the pipes 14 and 16. For example, the nozzles 18 are oriented so as to ensure that the pressurised water from the container 12 can be sprayed to all areas of the engine room 100 and to concentrate on areas of higher flame potential. Preferably, the pipes 14 and 16 are oriented about a roof of the engine room 100 and into the propeller shaft well 114. The nozzles 18 are then oriented downwardly and/or outwardly from the pipes 14 and 16. Typically, the plumbing network 36 is coupled to the pressurised container 12 by a flexible water way. Typically, the plumbing network 36 has a bore diameter not less than 12 mm. Also, the plumbing network 36 preferably is capable of withstanding internal pressures of at least 3000 kpa. Further, it is preferred that the plumbing network be of a looped design and that there be no ends in the lines of the plumbing network.

The nozzles 18 are typically formed from brass or stainless steel and include a swirl chamber and an elongate cone inlet filter. The swirl chamber increases the atomisation of water passing through it and the filter inhibits blockage 6f the swirl chamber by detritus material. The nozzles 18 typically produce a droplet size between 50 and 500 microns, more particularly between 250 and 400 microns. The spray pattern from the nozzles 18 is typically about 80° at a pressure of 2000 kpa (20 bar). Also, the nozzles 18 typically have a minimum orifice size of about 1 $mm^2$. The nozzles 18 use the liquid pressure alone to produce very finely atomised droplets in a hollow cone spray pattern with uniform distribution for achieving high misting performance. The nozzles 18 used in the exemplary embodiment are typically those available under the Registered Trade Mark UNIJET. The following specific nozzles are considered particularly useful:

| TYPE | FLOW RATE (L/MIN) | PRESSURE (BAR) |
|---|---|---|
| TN-4 | 0.65 | 20 |
| TN-6 | 0.83 | 20 |
| TN-8 | 0.96 | 20 |
| TN-10 | 1.06 | 20 |

The nature and size of the nozzles 18 to be used in a particular engine room 100 (or other risk area) depends upon a number of factors and can be calculated as shown in example 1.

EXAMPLE 1

To determine the quantity and type of nozzles 18 to use the following calculations can be performed.

The calculation is performed according to the following glossary of terms:

G.V.—the gross volume which represents the volume of the risk area (height H×width W×length L);

N.V.—the nett volume which represents the gross volume of the risk area minus all solid objects within it;

W.R.—water required which represents the amount of water required in litres to be introduced into the risk area;

N.N—the number of nozzles required to spray the mist into the risk area in a substantially uniform manner;

90FR—a ninety second flow rate which represents the volume of water which flows through each nozzle 18 in 90 seconds at 20 bar (typically 1.26 litres);

C.F.—a compensating factor which we have developed through experimentation for each flow rate of nozzle 18 as shown below:

2.8 for TN-4 type nozzle 18
2.1 for TN-6 type nozzle 18
1.8 for TN-8 type nozzle 18
1.1 for TN-10 type nozzle 18

W.V.—water volume in cubic metres (i.e. W.R./1000)

P.V.—potential vapour which represents the expansion ratio of vaporisation of water, namely 1700 * W.V.;

P.F.B.—potential fuel by-products due to combustion and represents the amount of $CO_2$ and $H_2O$ which are released as gases during combustion of the fuel, for example 212 grams of $C_{15}H_{32}$ (diesel) produces about 1525 litres of $CO_2$ and $H_2O$ under complete combustion, and about 1284 litres of $CO_2$ and $H_2O$ for a similar mass of $C_8H_{10}$ (xylene petrol);

The water capacity and the number of nozzles 18 required is then represented by the following formula:

W.R.=N.V./C.F.

N.N.=W.R./90FR

Thus given a risk area 7 m×4 m×1.7 m, with 3 obstructions one of which is 1 m×1 m×1 m and the other two obstruction being 1.8 m×0.9 m×0.8 m, and using nozzles 18 of the type TN-6 the number of nozzles 18 required is determined as follows:

$$\begin{aligned}
\text{G.V.} &= 7 \times 4 \times 1.7 \\
&= 47.6\ m^3 \\
\text{N.V.} &= \text{G.V.} - (1 \times 1 \times 1 + 2 \times (1.8 \times 0.9 \times 0.8)) \\
&= 47.6 - 3.492 \\
&= 44.008\ m_3 \\
\text{W.R.} &= 44.008/2.1 \\
&= 20.9\ l \\
\text{N.N.} &= 20.9/1.26 \\
&= 16.58\ \text{nozzles}
\end{aligned}$$

N.N.=17 NOZZLES

NB: Always round up to the nearest whole number i.e. in this case N.N. is 17 an the volume of water required W.R. must be adjusted accordingly (i.e. W.R. in this example is 21.4 litres).

The fire detectors 20 include a fixed temperature fire detector 40 and a rate of rise fire detector 42. The fixed temperature 40 typically includes a bimetallic strip with an extension rod which elevates a diaphragm to make a contact when the ambient temperature increases above a predetermined temperature. Typically, the fixed temperature is between 60 and 100° C. The rate of rise fire detector 42 typically includes a diaphragm and an air chamber, wherein the chamber leaks air through a fence tube in the diaphragm at relatively low rates of rise in temperature but which causes raising of the diaphragm to make a contact at relatively high rates of rise of the fire temperature. Typically, the rate of rise fire detector 42 is set to be active when the rate of rise in temperature is greater than about 9° C. per minute.

The detectors 20 also typically include smoke detectors. The smoke detectors are preferably located so as to detect air flowing out of the risk area to sense any smoke entrained in the air.

The control panel 22 is located so as to be easily accessed during a fire. For example, the control panel 22 may be located on the outside of the surrounding wall 102 of the engine room 100. The control panel 22 includes a wiring fault detection monitoring system and an activation system. The fault detection monitoring system monitors the wiring to the fire detectors 20 and the control valves 30 and 32 for open circuits, short circuits and unstable wiring conditions. The control panel 22 also senses the pressure in the pressurised container 22 and issues an alarm in the event that the pressure falls below a predetermined pressure. The activation system is of the "detonator" type which causes the control valves 30 and 32 to release the pressurised water from the container 12. Typically, the control panel 22 includes a mist release push button having a lift cover placed over it. The mist release push button is required to be activated to manually release the water from the container 12. The control panel 22 is also connected to visual and audible alarms located in the engine room 100.

In use, the fire extinguishing apparatus 10 is installed into a risk area, such as the engine room 100, by first calculating the number of nozzles required, the type of nozzles to use and the volume of water required for example as shown in Example 1. The nozzles 18 are then spaced about the engine room 100 along the pipes 14 and 16 to the pressurised container 12 via the control valves 30 and 32. The control panel 22 is located on the outside of the engine room 100 and wired into the fire detectors 20 and the control valves 30 and 32 and the audible and visual alarms.

In the event of a fire or rapid increase in temperature in the engine room 100 the fire detector 40 or 42 is triggered to initiate the control panel 22 to operate the control valves 30 and 32 to release water under pressure out of the container 12. The pressurised water passes along the pipes 14 and 16 to the nozzles 18. The water passes through the filter and swirl chamber of the nozzles 18 and forms a fine mist having a median droplet diameter between 250 and 500 microns. The median droplet diameter is an expression of the droplet size in terms of the volume of the liquid and is a value where 50% of the total volume of the liquid sprayed is made up of droplets with diameters larger than the median valve and 50% smaller than the median value.

The following test procedures were performed in a test rig situated in a forty foot cargo container having its access doors open at one end and with a plurality of the nozzles 18 located mid way up the side walls of the container. Flammable fuel was placed in a tray located on the floor of the container intermediate of the length of the container. The results of the tests are as follows:

TEST 1 Purpose: VISUAL DEMONSTRATION—ISOPROPANOL

| | |
|---|---|
| EXTINGUISHING MEDIUM | WATER MIST |
| FUEL | ISOPROPANOL |
| AMOUNT OF FUEL USED | 3 l |
| SURFACE AREA OF FIRE | 0.636 $m^2$ |
| DETECTION TIME | 5 s |
| NOZZLE SIZE | HF-16 |
| ORIFICE SIZE | 1.1 mm |
| CAPACITY EACH NOZZLE AT 20 BAR | 0.683 l/min |
| CAPACITY ALL NOZZLES AT 20 bar | 16.4 l/min |
| WATER PRESSURE | 2000 kpa (20 bar) |
| SPRAY ANGLE | 84° |
| NUMBER OF NOZZLES | 24 |
| NUMBER OF EFFECTIVE NOZZLES | 14 TO 16 |
| MEDIAN DROPLET SIZE | 375–400 MICRONS |
| TIME TO EXTINGUISH | 23 s |
| RATE OF ABSORPTION | 21.7° C./s |

The number of nozzles 18 which were effective was less than the total number of nozzles 18 since the doors of the container where open.

TEST 2 Purpose: VISUAL DEMONSTRATION—PETROL

| | |
|---|---|
| EXTINGUISHING MEDIUM | WATER MIST |
| FUEL | PETROL |
| AMOUNT OF FUEL USED | 3 l |
| SURFACE AREA OF FIRE | 0.636 $m^2$ |

-continued

| | |
|---|---|
| DETECTION TIME | 3 s |
| NOZZLE SIZE | HF-16 × 16<br>HF-32 × 8 |
| ORIFICE SIZE | HF-16 = 1.1 mm<br>HF-32 = 1.5 mm |
| CAPACITY EACH NOZZLE AT 20 bar | 21.8 l/min |
| WATER PRESSURE | 2000 kpa (20 bar) |
| SPRAY ANGLE | HF-16 = 84°<br>HF-32 = 91° |
| NUMBER OF NOZZLES | 24 |
| NUMBER OF EFFECTIVE NOZZLES | 16 |
| MEDIAN DROPLET SIZE micron | HF-16 = 375–400<br>HF-32 = 350–375 micron |
| TIME TO EXTINGUISH | 13 s |
| RATE OF ABSORPTION | 1.123° C./s |

TEST 3 Purpose: VISUAL DEMONSTRATION—DIESEL

| | |
|---|---|
| EXTINGUISHING MEDIUM | WATER MIST |
| FUEL | DIESEL |
| AMOUNT OF FUEL USED | 3 l |
| SURFACE AREA OF FIRE | 0.363 $m^2$ |
| DETECTION TIME | 12 s |
| NOZZLE SIZE | HF-16 |
| ORIFICE SIZE | 1.1 mm |
| CAPACITY EACH NOZZLE AT 20 bar | 0.683 l/min |
| CAPACITY ALL NOZZLES AT 20 bar | 16.4 l/min |
| WATER PRESSURE | 2000 kpa (20 bar) |
| SPRAY ANGLE | 84° |
| NUMBER OF NOZZLES | 24 |
| NUMBER OF EFFECTIVE NOZZLES | 24 |
| MEDIAN DROPLET SIZE | 375–400 MICRONS |
| TIME TO EXTINGUISH | 6 s |
| RATE OF ABSORPTION | 0.33° C./s |

TEST 4 Purpose: COMPARISON OF MIST WITH $CO_2$

| | |
|---|---|
| EXTINGUISHING MEDIUM | WATER MIST |
| FUEL | PETROL |
| AMOUNT OF FUEL USED | 2 l |
| SURFACE AREA OF FIRE | 0.636 $m^2$ |
| DETECTION TIME | 5 s |
| NOZZLE SIZE | HF-16 |
| ORIFICE SIZE | 1.1 mm |
| CAPACITY EACH NOZZLE AT 20 bar | 0.683 l/min |
| CAPACITY ALL NOZZLES AT 20 bar | 16.4 l/min |
| SPRAY ANGLE | 84° |
| NUMBER OF NOZZLES | 24 |
| NUMBER OF EFFECTIVE NOZZLES | 24 |
| MEDIAN DROPLET SIZE | 375–400 MICRONS |
| TIME TO EXTINGUISH | 12 s |

This is hereinafter referred to as the "mist test".

TEST 5 Purpose: COMPARISON OF MIST WITH $CO_2$

| | |
|---|---|
| EXTINGUISHING MEDIUM | CARBON DIOXIDE |
| FUEL | PETROL |
| AMOUNT OF FUEL USED | 2 l |
| SURFACE AREA OF FIRE | 0.636 $m^2$ |
| DETECTION TIME | 5 s |
| QUANTITY OF $CO_2$ | 32 kg |

-continued

| | |
|---|---|
| NUMBER OF NOZZLES | 6 |
| NUMBER OF EFFECTIVE NOZZLES | 6 |
| TIME TO EXTINGUISH | 17 s |

This is hereinafter referred to as the "$CO_2$ test".

Figure 2:
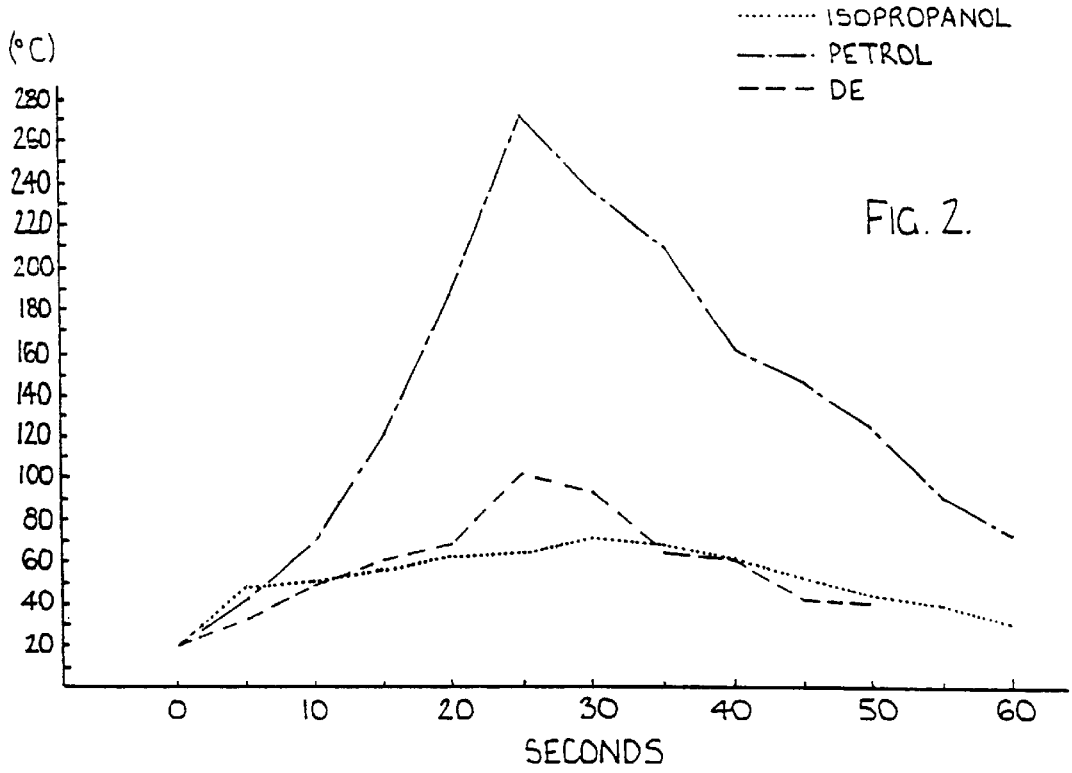
FIG. 2 is a graph showing the fire extinguishing capabilities of the fire extinguishing apparatus of FIG. 1, in a test facility, for extinguishing ignited isopropanol, petrol and diesel.

In the test procedures each of the fuels was ignited and allowed to flame up for between 25 to 60 seconds, after which time the fire extinguishing apparatus 10 was activated to extinguish the fire. The temperature inside the container was monitored from the time of ignition of the fuel until after extinguishing of the fire produced thereby. These results are shown graphically in FIGS. 2 and 3. FIG. 2 relates to tests 1 to 3, and tests 4 and 5 are shown graphically in FIG. 3. An arrow indicated "I" represents the point in time at which the fuel was ignited and an arrow indicated "E" indicates the point in time at which the fire was extinguished.

Figure 3:
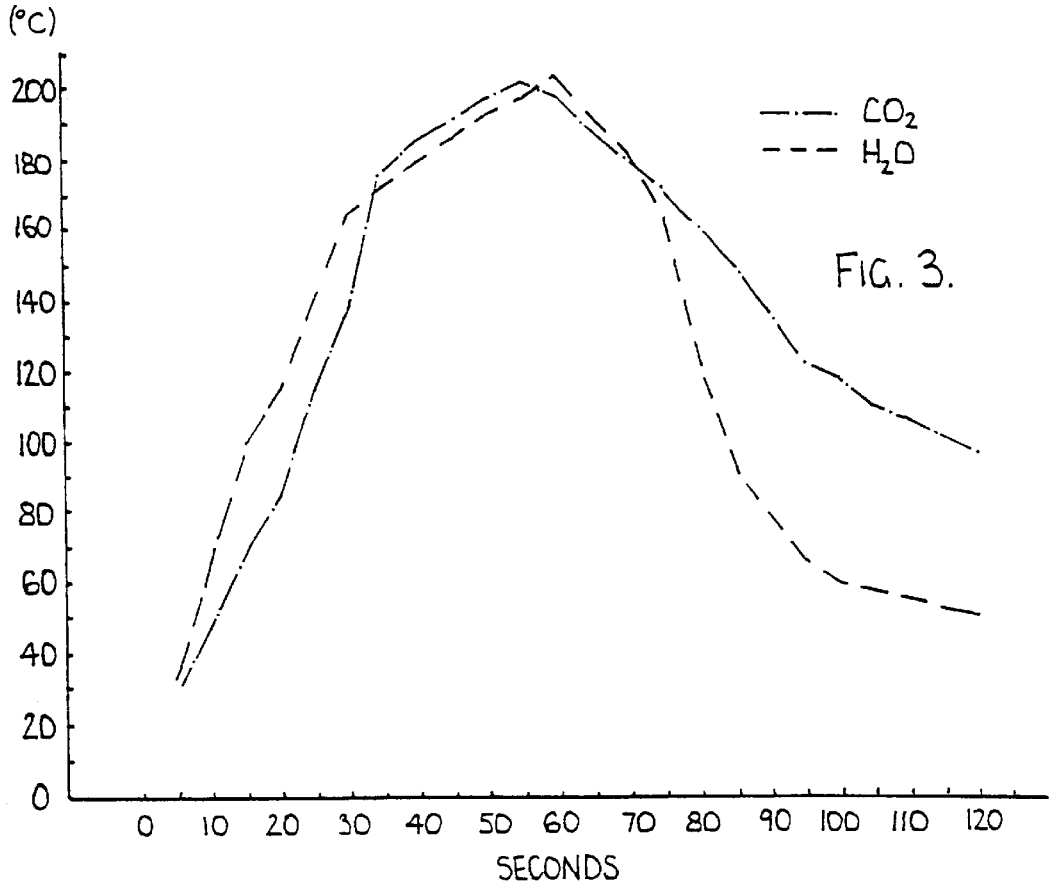
FIG. 3 is a graph similar to FIG. 2 but showing a comparison of the extinguishing capabilities of the fire extinguishing apparatus of FIG. 1 and the use of carbon dioxide on ignited petrol.

The result of each of the tests of the fire extinguishing apparatus 10 is that the fire was extinguished in a relatively short period of time and typically less than the 25 seconds. It should also be noted, particularly as shown in FIG. 3, that the temperature reducing effect of the fire extinguishing apparatus 10 is greater than that of carbon dioxide. This occurs because as the temperature in the risk area increases the volume of the water mist increases dramatically as it changes state from water mist to water vapour. Water vapour has a volume which is 1700 times greater than the volume of the water from which it was produced. Hence, the water vapour further displaces the oxygen from the risk area and inhibits the risk area from maintaining combustion. Also, in the change of state of the water from liquid to gas it absorbs heat 540 times greater than that of the liquid phase. Further, the increase in temperature of the risk area decreases the specific gravity of the water which increases its velocity, decreases its droplet size and increases the flow of the water throughout the risk area. That is, the water mist is more effective with increase in temperature of the risk area. This does not usually occur with other fire fighting mediums.

Figure 4:
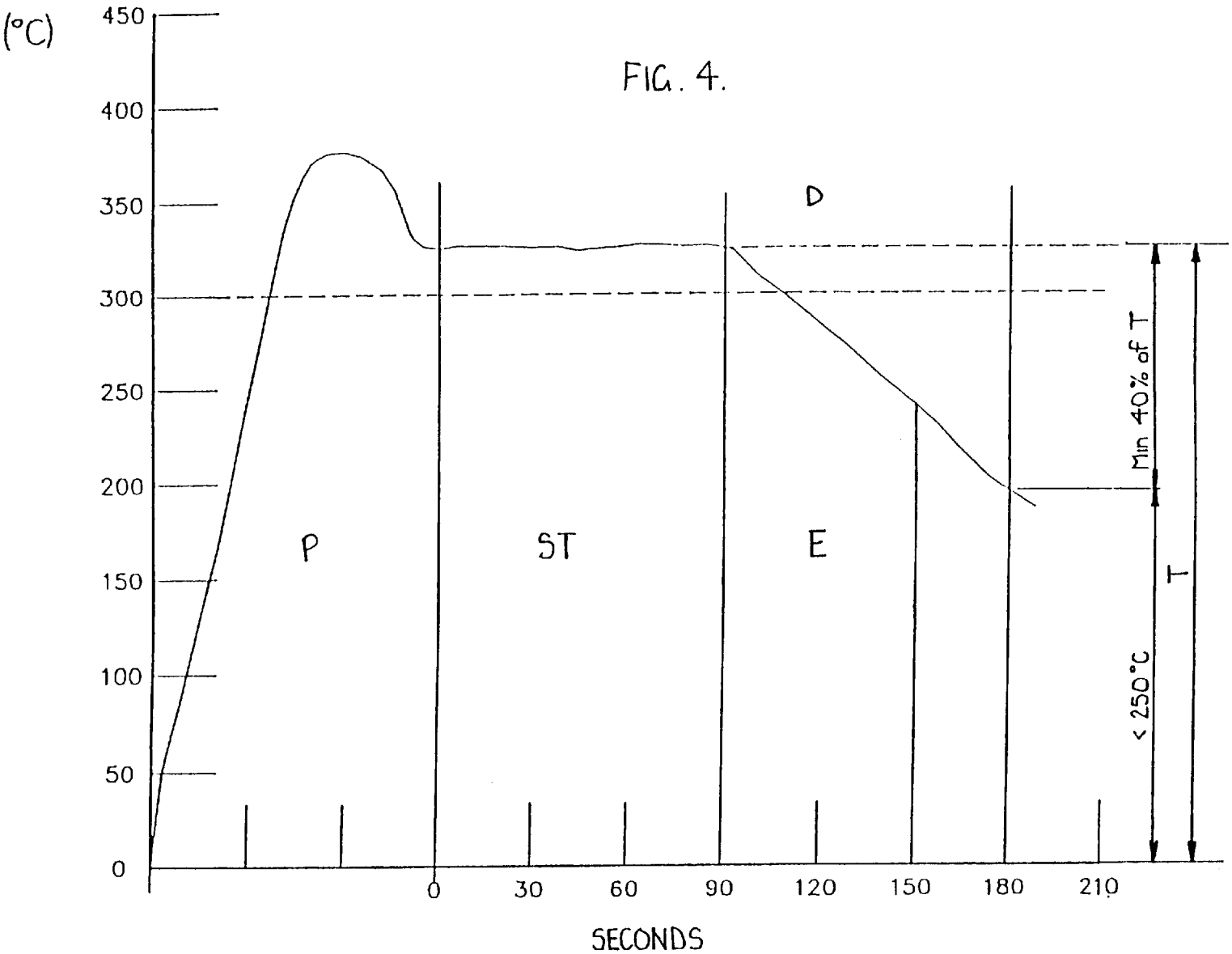
FIG. 4 is a graph showing typical maximum fire temperature characteristics of fires treated with the fire extinguishing apparatus of FIG. 1.
Figure 6:
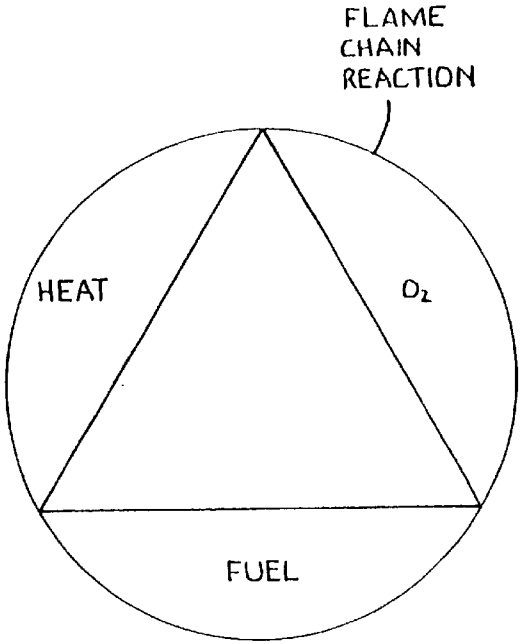

In FIG. 4 there is shown a graph of temperature versus time showing the minimum operational characteristics of the fire extinguishing apparatus 10. The graph shows a pre-burn period denoted P, a stabilising temperature period denoted ST (which is typically 90 seconds) and at the end of which the fire extinguishing apparatus 10 is activated. Thereafter, the fire is extinguished within an extinguishing period denoted E which is typically less than 60 seconds and the container 12 is fully discharged within a discharge period denoted D which is typically greater than 90 seconds. During the pre-burn period the risk area typically reaches a temperature in excess of 300° C., which temperature is maintained during the temperature stabilisation period ST. Typically, the temperature in the risk area is reduced to 60% of the temperature in the stabilised temperature period ST before the container 12 is fully discharged. Typically,the final temperature within the risk zone is less than 250° C. The tests shown in FIGS. 2 and 3 show that these results are achievable with the fire extinguishing apparatus 10 of the present invention.

Figure 5:
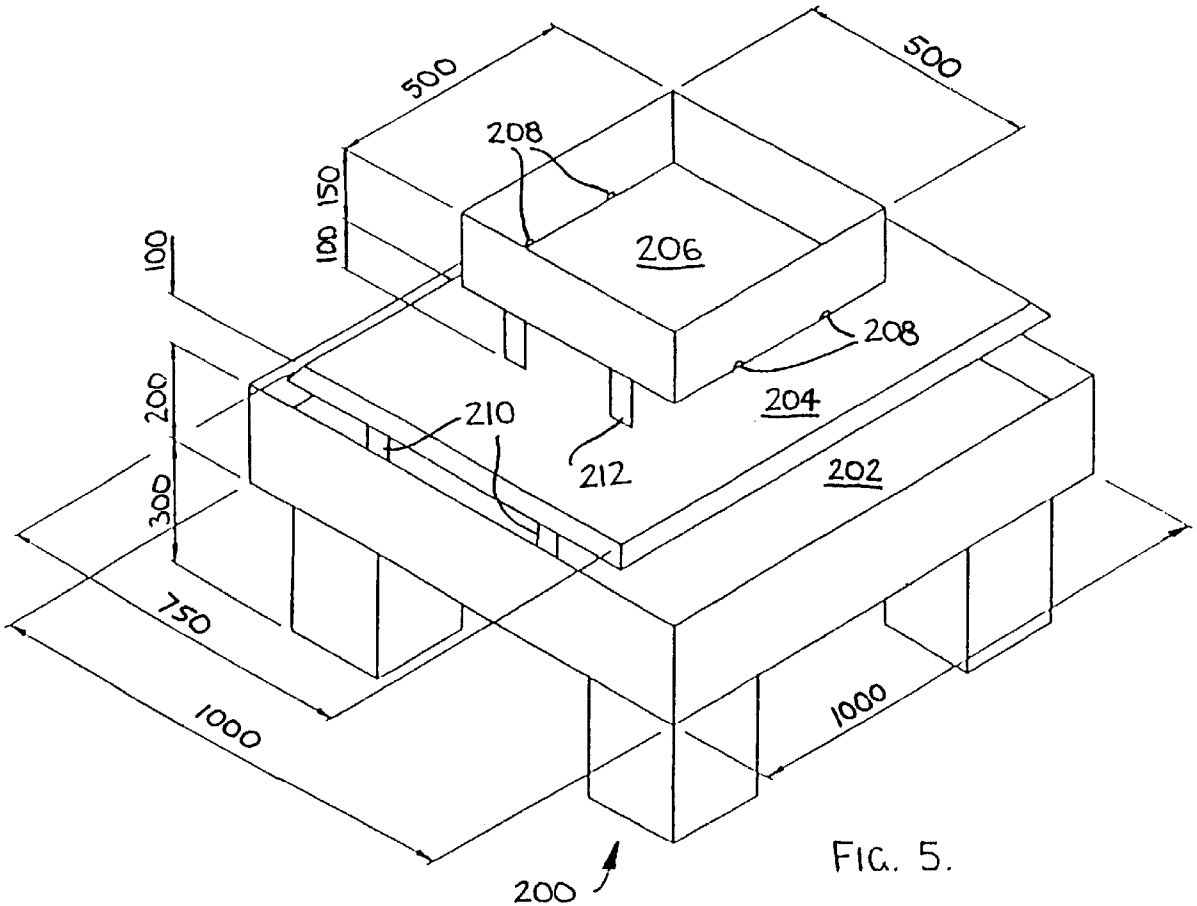
FIG. 5 is a cascade test facility for testing the fire extinguishing apparatus of FIG. 1; and, FIG. 6 is a pictorial representation of the combustion triangle and flame chain reaction circle.

The abovementioned test were conducted using a cascade apparatus 200 shown in FIG. 5. Th cascade tray 204 is designed to simulate fuel leaking onto a hot manifold. The cascade apparatus 200 comprises a relatively large box tray 202 having an area of approximately 1 square metre, a flat cascade tray 204 having a surface area of approximately 0.5 square metres, upon which is located a relatively small box tray 206. The small box tray 206 has a plurality of holes 208 for allowing diesel from the box tray 206 to fall onto the flat cascade tray 204. The cascade tray 204 has legs 210 spacing it above the tray 202, and the tray 206 has legs 212 spacing it above the cascade tray 204. Typically, the tray 202 has petrol and/or isopropanol located in it. In use, the cascade tray 204 becomes extremely hot and causes ignited fuel from the tray 206 to explode and be projected off the cascade apparatus 200.

A further test of the fire extinguishing apparatus 10 of the present invention was conducted in a risk area having a volume of 500 $m^3$ (10 m×10 m×5 m) with 190 of the same nozzles 18 as used in the previous test. In this test 90 litres of fuel was used having an area of 7 $m^2$. The fuel was contained in the cascade tray 204 and 6 other trays including pool fires and a diesel oil pressure fire (representing a fire from a ruptured fuel line). All of the trays were ignited and allowed to burn for two minutes before activation of the fire extinguishing apparatus 10 of the present invention.

During the test it was observed that the colour of he combustion by-products changed from thick black to white immediately the fire extinguishing apparatus 10 was started. The results of the test was that all of the fires were extinguished within 30 seconds and observers walked into the risk area before the completion of the 90 second period over which the mist is released into the risk area. The observers experienced no difficulty in breathing during that time. It appears from this test that the fire extinguishing apparatus 10 lead to suppression of smoke and causes combustion by-products to fall out of the air.

The fire extinguishing apparatus 10 of the present invention has the advantage that it can use water mist to fill a risk area so as to interrupt the flame chain reaction in the combustion cycle so as to prevent combustion within the risk area. Also, the water vapour has the effect of greatly reducing the heat within the risk area and displacing oxygen within the risk area due to the change in the state of the water from a liquid to a vapour (mist). Hence, the fire extinguishing apparatus 10 of the present invention has the surprising result that it can use a relatively small quantity of water to extinguish a flame caused by a relatively large quantity of highly flammable liquid. In Table 1 there is shown a comparison of the benefits of the fire extinguishing apparatus 10 of the present invention (referred to as MISTEX) with conventional fire extinguishing systems.

TABLE 1

| | COMPARISONS | | | |
|---|---|---|---|---|
| | SPRINKLER | HALON | $CO_2$ | MISTEX |
| NON-TOXIC | YES | NO | NO | YES |
| EXTINGUISH A & B CLASS FIRES | NO | YES | YES | YES |
| ENVIRONMENTALLY FRIENDLY | YES | NO | NO | YES |
| REQUIRED FIRE PUMP | YES | NO | NO | NO |
| LIGHT WEIGHT | NO | YES | NO | YES |
| SERVICE ACCESSIBLE BY CREW | NO | NO | NO | YES |
| HIGH HEAT ABSORPTION | YES | NO | NO | YES |
| COST EFFECTIVENESS | NO | YES | NO | YES |
| RUNNING TIME (IN-BUILT SAFETY) | N/A | NO | NO | YES |
| NO EVACUATION PLAN REQUIRED | YES | NO | NO | YES |
| SERVICE AND REFILL COST EFFECTIVENESS | N/A | NO | NO | YES |
| EFFECTIVE IN SEMI-VENTILATED AREAS | YES | NO | NO | YES |

Modifications and variations such as would be apparent to a skilled addressee are considered within the scope of the present invention. For example, a heat absorber and fuel emulsifier such as, for example, a liquid under the trade mark PHIREX could be added to the water to increase its fire extinguishing capabilities. Also, any form of fire detector could be used in the fire extinguishing apparatus, such as, for example, radioisotope based fire detectors, ionic chamber detectors, beam detectors, ultraviolet detectors or the like.

What is claimed is:

1. A fire extinguishing apparatus for extinguishing a fire located in a risk area, the fire extinguishing apparatus comprising:

spray means for spraying non-flammable liquid therefrom into the risk area, delivery means for passage of the non-flammable liquid for delivery thereof under pressure to said spray means, detector means for detecting the presence of a fire in the risk area, and fluid delivery control means to allow delivery of the non-flammable liquid via said delivery means to said spray means following actuation of said fluid delivery control means, wherein, in use, said spray means sprays the non-flammable liquid therefrom to form a mist having a median droplet size of substantially 500 microns or less, said non-flammable liquid is sprayed from said spray means at a rate of substantially 1 liter or less per minute per cubic meter of volume of the risk area, and said non-flammable liquid is sprayed from said spray means into said risk area to form said mist the non-flammable liquid, such that said mist of non-flammable liquid droplets can be applied to the fire to extinguish the fire.

2. A fire extinguishing apparatus according to claim 1, wherein the median droplet size is between 250 and 400 micron.

3. A fire extinguishing apparatus according to claim 1, wherein the spray means comprises a plurality of nozzles, the number of nozzles required for the risk area being determined as a function of the air volume of the risk area, the flow rate of the nozzles and a compensating factor, the function being:

$$N.N.=[A.V./C.F.]/90FR$$

where

N.N. is the number is nozzles,

A.V. is the air volume of the risk area,

C.F. is the compensating factor, and

90FR is a volume of water which flows through one of the nozzles in 90 seconds.

4. A fire extinguishing apparatus according to claim 3, wherein the nozzles each have a discharge rate of <2 liters/minute.

5. A fire extinguishing apparatus according to claim 3, wherein the nozzles each have a spray angle of >70°.

6. A fire extinguishing apparatus according to claim 3, wherein the nozzles each have a hollow spray pattern.

7. A fire extinguishing apparatus according to claim 3, wherein, in use, the nozzles are spaced about 1 meter apart in the risk area.

8. A fire extinguishing apparatus according to claim 1, wherein the detector means comprises a temperature detector set to become active at between 60–100° C.

9. A fire extinguishing apparatus according to claim 1, wherein the detector means comprises a rate of temperature rise detector set to detect rates of temperature rise of greater than about 9° C./min.

10. A fire extinguishing apparatus according to claim 1, wherein the detector means comprises a smoke detector.

11. A fire extinguishing apparatus according to claim 1, wherein the mist is breathable.

12. A fire extinguishing apparatus according to claim 1, wherein propelling means is provided for propelling the non-flammable liquid via said delivery means to said spray means and said propelling means comprises dry nitrogen stored under pressure in a storage reservoir.

13. A fire extinguishing apparatus according to claim 1, wherein the non-flammable liquid is water.

14. A fire extinguishing apparatus according to claim 1, wherein said non-flammable liquid is sprayed from said spray means at a rate in the range from 0.1 liter per minute per cubic meter of volume of the risk area to 0.63 liter per minute per cubic meter of volume of the risk area.

15. A fire extinguishing apparatus according to claim 1, wherein said non-flammable liquid is sprayed from said spray means at a rate in the range from 0.25 liter per minute per cubic meter of volume of the risk area to 0.44 liter per minute per cubic meter of volume of the risk area.

16. A fire extinguishing apparatus according to claim 1, wherein the median droplet size is between substantially 50 and 500 microns.

17. A fire extinguishing apparatus according to claim 1, wherein, in use, said spray means operates for substantially 90 seconds or less to extinguish the fire.

18. A fire extinguishing apparatus according to claim 1, wherein, in use, the non-flammable liquid is delivered from a storage reservoir means via said delivery means to said spray means.

19. A fire extinguishing apparatus according to claim 18, wherein said storage reservoir means comprises a container.

20. A fire extinguishing apparatus according to claim 1, wherein propelling means is provided for propelling the non-flammable liquid via said delivery means to said spray means.

21. A fire extinguishing apparatus according to claim 20, wherein, in use, said propelling means propels the non-flammable liquid at a pressure of substantially 2000 kPa or less.

22. A fire extinguishing apparatus according to claim 20, wherein the propelling means comprises a pressurized gas.

23. A fire extinguishing apparatus according to claim 1, wherein control means is provided and enables actuation of said fluid delivery control means from a location remote from said fluid delivery control means.

24. A fire extinguishing apparatus according to claim 23, wherein said control means is provided in operative association with said detector means for controlling delivery of said non-flammable liquid to said spray means.

25. A fire extinguishing apparatus according to claim 24, wherein upon said detector means detecting the presence of a fire in the risk area, said detector means initiates said control means to actuate said fluid delivery control means.

26. A fire extinguishing apparatus according to claim 1, wherein said fluid delivery control means comprises at least one valve.

27. A fire extinguishing apparatus according to claim 1, wherein the non-flammable liquid is an aqueous solution.

28. A fire extinguishing apparatus according to claim 1, wherein the non-flammable liquid contains additives.

29. A fire extinguishing apparatus according to claim 3, wherein each said nozzle comprises a swirl chamber to increase atomization of the non-flammable liquid that passes therethrough.

30. A fire extinguishing apparatus according to claim 3, wherein, in use, said nozzles are arranged such that non-flammable liquid is sprayed to all areas of the risk area.

31. A method of extinguishing a fire in a risk area comprising the steps of:

detecting the presence of a fire in the risk area, actuating fluid delivery control means for delivery of a non-flammable liquid, delivering the non-flammable liquid under pressure to spray means, and directing a spray of the non-flammable liquid from the spray means into the risk area, characterized by spraying the non-flammable liquid into the risk area to form a mist having a median droplet size of substantially 500 microns or less, spraying the non-flammable liquid at a rate of substantially 1 liter or less per minute per cubic meter of volume of the risk area, and spraying the non-flammable liquid into the risk area to form said mist of the non-flammable liquid, such that said mist of non-flammable liquid droplets is applied to the fire to extinguish the fire.

32. A method of extinguishing a fire according to claim 31, wherein the non-flammable liquid is sprayed from the spray means at a rate in the range from 0.25 liter per minute per cubic meter of volume of the risk area to 0.44 liter per minute per cubic meter of volume of the risk area.

33. A method of extinguishing a fire according to claim 31, wherein the non-flammable liquid is sprayed from the spray means at a rate in the range from 0.25 liter per minute per cubic meter of volume of the risk area to 0.44 liter per minute per cubic meter of volume of the risk area.

34. A method of extinguishing a fire according to claim 31, wherein the non-flammable liquid is sprayed from the spray means into the risk area to form a mist having a median droplet size between substantially 50 and 500 microns.

35. A method of extinguishing a fire according to claim 31, wherein the non-flammable liquid is sprayed from the spray means into the risk area to form a mist having a median droplet size between substantially 250 and 400 microns.

36. A method of extinguishing a fire according to claim 31, further comprising operating the spray means for substantially 90 seconds or less to extinguish the fire.

37. A method of extinguishing a fire according to claim 31, further comprising delivering the non-flammable liquid from a storage reservoir means via delivery means to said spray means.

38. A method of extinguishing a fire according to claim 31, further comprising propelling the non-flammable liquid under pressure to the spray means.

39. A method of extinguishing a fire according to claim 31, wherein the non-flammable liquid is propelled at a pressure of substantially 2000 kPa or less.

40. A method of extinguishing a fire according to claim 31, further comprising actuating said fluid delivery control means from a location remote from said fluid delivery control means.

41. A method of extinguishing a fire according to claim 31, further comprising initiating control means to actuate said fluid delivery control means upon detecting the presence of a fire in the risk area by detector means.

42. A method of extinguishing a fire according to claim 31, wherein the spray means comprises a plurality of nozzles, and determining the number of nozzles required for the risk area as a function of the air volume of the risk area, the flow rate of the nozzles and a compensating factor, the function being:

$$N.N=[A.V./C.F.]/90FR$$

where

N.N. is the number of nozzles,

A.V. is the air volume of the risk area,

C.F. is the compensating factor as hereinbefore defined, and

90FR is the volume of water which flows through one of the nozzles in 90 seconds.

43. A method of extinguishing a fire according to claim 42, wherein the non-flammable liquid is sprayed from the nozzles at a discharge rate of less than substantially 2 litres/minute.

44. A method of extinguishing a fire according to claim 42, wherein the non-flammable liquid is sprayed from each nozzle at a spray angle of greater than substantially 70°.

45. A method of extinguishing a fire according to claim 42, wherein the non-flammable liquid is sprayed from each nozzle with a hollow spray pattern.

46. A method of extinguishing a fire according to claim 42, wherein the nozzles are spaced about 1 meter apart in the risk area.

47. A method of extinguishing a fire according to claim 42, further comprising arranging the nozzles such that the non-flammable liquid is sprayed to all areas of the risk area.

48. A method of extinguishing a fire according to claim 31, further comprising detecting the presence of a fire by detecting an increase in temperature above a predetermined temperature.

49. A method of extinguishing a fire according to claim 48, wherein said predetermined temperature is in the range of substantially 60° to 100° C.

50. A method of extinguishing a fire according to claim 31, further comprising detecting the presence of a fire by detecting rates of temperature rise of greater than about 9° C./min.

51. A method of extinguishing a fire according to claim 31, further comprising detecting the presence of a fire by detecting smoke in the risk area.

52. A method of extinguishing a fire according to claim 31, wherein the non-flammable liquid is water.

53. A method of extinguishing a fire according to claim 31, wherein the non-flammable liquid is an aqueous solution.

54. A method of extinguishing a fire according to claim 31, wherein the non-flammable liquid contains additives.

* * * * *

Disclaimer

6,637,518 B1 — Hillier et al., Fremantle (AU). FIRE EXTINGUISHING APPARATUS. Patent dated Oct. 28, 2003, Disclaimer filed Sep. 29, 2004, by the Assignee, Invention Technologies Pty. Ltd.

This patent is subject to a terminal disclaimer.

(*Official Gazette June 14, 2005*)